US007153237B2

(12) United States Patent
Norton

(10) Patent No.: US 7,153,237 B2
(45) Date of Patent: Dec. 26, 2006

(54) APPARATUS FOR ENHANCING EXERCISES AND METHODS OF USING SAME

(76) Inventor: Jewellita F. Norton, 121 S. Market, Cordell, OK (US) 73632

( * ) Notice: Subject to any disclaimer, the term of this patent is extended or adjusted under 35 U.S.C. 154(b) by 0 days.

(21) Appl. No.: 11/028,250

(22) Filed: Jan. 3, 2005

(65) Prior Publication Data

US 2005/0192157 A1 Sep. 1, 2005

Related U.S. Application Data

(63) Continuation-in-part of application No. 10/407,987, filed on Apr. 4, 2003, now abandoned, which is a continuation-in-part of application No. 10/301,334, filed on Nov. 20, 2002, now abandoned, which is a continuation of application No. 09/835,187, filed on Apr. 12, 2001, now Pat. No. 6,514,176.

(51) Int. Cl.
*A63B 23/03* (2006.01)

(52) U.S. Cl. ..... 482/11

(58) Field of Classification Search ..... 482/11, 482/121; 601/38; 128/845, 848, 859, 861
See application file for complete search history.

(56) References Cited

U.S. PATENT DOCUMENTS

| | | | | |
|---|---|---|---|---|
| 1,851,865 | A | 3/1932 | Ptacek | |
| 3,014,286 | A | 12/1961 | Hricak | |
| 3,118,667 | A | 1/1964 | Barons | |
| 3,525,520 | A | 8/1970 | Dwyer | |
| 3,528,655 | A | 9/1970 | Ruderian | |
| 3,547,433 | A | 12/1970 | Robins | |
| 3,813,096 | A | 5/1974 | Welch | |
| 4,280,696 | A | 7/1981 | Ramon | |
| 4,671,260 | A | 6/1987 | Buckner | |
| 4,862,903 | A * | 9/1989 | Campbell | 128/861 |
| 4,944,313 | A * | 7/1990 | Katz et al. | 128/859 |
| 5,253,658 | A | 10/1993 | King | |

(Continued)

OTHER PUBLICATIONS

Cain, et al., "Prosthetic Management of Electrical Burns to the Oral Commissure", Quinessence of Dental Technology, Apr. 1985, pp. 249-252.

(Continued)

*Primary Examiner*—Jerome Donnelly
*Assistant Examiner*—Fenn C. Mathew
(74) *Attorney, Agent, or Firm*—Dunlap, Codding & Rogers, P.C.

(57) ABSTRACT

The present invention relates to an apparatus for enhancing isometric and/or isotonic exercises and methods of using same. In particular, the apparatus for enhancing isometric exercises includes a substantially rigid annular exercising assembly which is placed in a user's mouth and held in place by the user's lips and more particularly between the user's lips in such a manner that the user's upper and lower teeth are not in a substantially engaged position. The substantially rigid annular exercising assembly has an exterior and an interior wall which connect and thereby form a trough. The anterior, medial and posterior surfaces of the user's lips fit within the trough thereby providing the mechanism for holding the substantially rigid annular exercising assembly within the user's mouth during exercise. In this manner, the substantially rigid annular exercising assembly is essentially freestanding and does not require the user to grind their teeth, or tense or strain the jaw or Templar-Mandibular Joint. When in place, the substantially rigid annular exercising assembly increases isometric resistance during exercise, weight training, or facial toning. When used as an isotonic exercising aid, the apparatus would be substantially flexible or semi-flexible to thereby allow some movement of a user's jaw and other facial muscles.

8 Claims, 6 Drawing Sheets

U.S. PATENT DOCUMENTS 5,556,357 A 9/1996 Hanna
5,590,643 A * 1/1997 Flam ..... 128/200.26
5,921,240 A 7/1999 Gall
6,148,820 A * 11/2000 Herrin ..... 128/857
6,203,471 B1 3/2001 Akihiro
6,524,262 B1 * 2/2003 Akihiro ..... 601/38
6,722,360 B1 * 4/2004 Doshi ..... 128/200.24

OTHER PUBLICATIONS

"Obstructive Sleep Apnea—Fitting the Oracle", Fisher & Paykel Healthcare, Jul. 2002, 4 pages.

* cited by examiner

APPARATUS FOR ENHANCING EXERCISES AND METHODS OF USING SAME

CROSS REFERENCE TO RELATED APPLICATIONS

This application is a continuation-in-part of U.S. Ser. No. 10/407,987, filed Apr. 4, 2003 now abandoned, entitled "APPARATUS FOR ENHANCING EXERCISES AND METHODS OF USING SAME"; which is a continuation-in-part of U.S. Ser. No. 10/301,334, filed Nov. 20, 2002 now abandoned, entitled "APPARATUS FOR ENHANCING ISOMETRIC EXERCISES AND METHODS OF USING SAME;" which is a continuation of U.S. Ser. No. 09/835,187, filed Apr. 12, 2001, entitled "APPARATUS FOR ENHANCING ISOMETRIC AND METHODS OF USING SAME," now U.S. Pat. No. 6,514,176, the contents of all of which are hereby expressly incorporated herein in their entirety by reference.

BACKGROUND OF THE INVENTION

Field of the Invention

The present invention relates to an apparatus for enhancing isometric and/or isotonic exercises and methods of using same. In particular, the apparatus for enhancing isometric exercises includes a substantially rigid annular exercising assembly which is placed in a user's mouth and held in place by the user's lips and more particularly between the user's lips in such a manner that the user's upper and lower teeth are not in a substantially engaged position. The substantially rigid annular exercising assembly has an exterior and an interior wall which connect and thereby form a trough. The anterior, medial and posterior surfaces of the user's lips fit within the trough thereby providing the mechanism for holding the substantially rigid annular exercising assembly within the user's mouth during exercise. In this manner, the substantially rigid annular exercising assembly is essentially freestanding and does not require the user to grind their teeth, or tense, or strain the jaw or Templar-Mandibular Joint. When in place, the substantially rigid annular exercising assembly increases isometric resistance during exercise, weight training, or facial toning. When used as an isotonic exercising aid, the apparatus would be substantially flexible or semi-flexible to thereby allowing some movement of a user's jaw and other facial muscles.

SUMMARY OF THE PRIOR ART AND HISTORICAL BACKGROUND

During exercise, everyday lifting of heavy objects, child-bearing and/or during defecation, muscles which surround the larynx are tensed thereby resulting in a bracing of the larynx, through such isolation and straining of the larynx muscle, fatigue and discomfort is encouraged. Thus, it becomes apparent that the muscle groups integral to the larynx are important to weight lifting and other day to day tasks. When used in such a manner, the larynx acts as a focal bracing point which allows for the straining individual to use the respective muscle groups in order to achieve any of the enumerated tasks. Individuals who have had larnygectomies are typically hindered in their efforts to accomplish such tasks. Further, through isolation and use of the larynx muscle groups, an individual is capable of greater feats of strength than the mere use of muscles of the arms, legs, and/or body along. Indeed, through isolation and tensing of the larynx during exertions of physical strength, other muscle groups are tensed in a "chain reaction" mechanism. Thus, the larynx and the muscle groups surrounding the larynx are important components in aiding activities in which muscle groups must be tensed and/or strained.

Prior art muscle toning apparatuses include U.S. Pat. No. 5,556,357 to Hanna; U.S. Pat. No. 3,014,286 to Hricak; U.S. Pat. No. 3,547,433 to Robins; and U.S. Pat. No. 4,280,696 to Ramon. All of these patents have a fatal and potentially dangerous flaw—each describes an apparatus which requires the tensing and clinching of the jaw as well as a sustained force which is placed upon the teeth that are in contact with the apparatus. For example, in the Hanna '357 patent it is the user's teeth which rest upon the apparatus to exert opposite opposing force against one another. Also, as shown in the Hricak '286 patent, the apparatuses oftentimes placed the user's tongue in an unnatural position and places the jaw in a clinched and tensed position. Prolonged use of these types of devices may lead to jaw joint pain (Templar-Mandibular Joint—"TMJ" problems), incorrect positioning of the tongue resulting in suffocation and speech difficulties, as well as the degradation of the user's teeth which may also result in speech and eating difficulties. Clearly, the use of these prior art devices was at the user's own peril.

Through use of the present invention, the muscles surrounding the larynx are "hyper" tensed—through such "hyper" tension, increased levels of tone and strength is found throughout the above-enumerated muscle groups. Also, if the present invention is used during isometric or isotonic exercises in conjunction with external stimulation, or alone, the same isolation and tensing of the musculature occurs. Thus, the present invention enhances isometric or isotonic exercise thereby increasing the effectiveness of the exercise—less time is required, better body/muscle tone is achieved, healthier tissue is promoted surrounding the joints, and better posture and overall health is achieved.

The present invention, therefore, discloses an apparatus for enhancing isometric or isotonic exercises as well as methods of using same. The apparatus disclosed and claimed herein does not suffer from the same problems as the prior art devices. Indeed, the present invention maintains the jaw in a substantially relaxed position whereby the user's teeth are not in contact with one another.

SUMMARY OF THE INVENTION

The present invention is directed to an isometric or isotonic resistance apparatus. The isometric or isotonic resistance apparatus includes a substantially rigid annular exercising assembly in one embodiment and a substantially flexible or semi-flexible annular exercising assembly in another embodiment either of which is sized and shaped so as to fit between the user's lips. The annular exercising assembly is further characterized as having an exterior wall and an interior wall and a trough formed by the connection of the exterior wall to the interior wall, wherein the trough is sized and shaped to accept the user's lips therein. When the user's lips are inserted in the trough, the user's upper and lower teeth are kept in a substantially non-engaged position.

In one embodiment the interior wall has an exterior surface substantially adjacent an exterior peripheral surface of the user's teeth and wherein the exterior wall has an interior surface which is substantially adjacent an exterior peripheral surface of a user's mouth. The apparatus may also be fabricated from a plastic or from plastic laminates or other composite materials which are moldable and capable of being fitted and fine-tuned to fit the size and shape of a user's individual mouth. Any material which allows for either isometric or isotonic exercise and which is also suitable for hygienic use in a user's mouth is considered for use in the present invention.

The present invention also includes methods for enhancing isometric or isotonic resistance during exercise. One such method includes the steps of providing a substantially rigid annular exercising assembly or a substantially flexible or semi-flexible annular exercising assembly which is sized and shaped so as to fit in a user's mouth between an upper lip area and a lower lip area. The substantially rigid annular exercising assembly has an exterior wall and an interior wall and a trough formed by the connection of the exterior wall to the interior wall. The trough is sized and shaped to accept the user's lips therein, and when the user's lips are inserted in the trough, the user's upper and lower teeth are kept in a substantially non-engaged position. A second or additional step includes placing the substantially rigid annular exercising assembly in the user's mouth between the upper lip area and the lower lip area. Finally, the user compresses the substantially rigid annular exercising assembly between the upper lip area and the lower lip area and performs a predetermined exercise while the substantially annular exercising assembly is compressed between the upper lip area and the lower lip area.

In a preferred embodiment, during the step of providing a substantially rigid annular exercising assembly, the interior wall has an exterior surface substantially adjacent an exterior peripheral surface of the user's teeth and wherein the exterior wall has an interior surface which is substantially adjacent an exterior peripheral surface of a user's mouth. Also, the substantially rigid annular exercising assembly may be fabricated from a plastic or plastic laminate or other composite moldable materials. Any material which allows for either isometric or isotonic exercise and which is also suitable for hygienic use in a user's mouth is considered for use in the present invention.

BRIEF DESCRIPTION OF THE SEVERAL VIEWS OF THE DRAWINGS

FIG. 6 is a side plan view of the annular exercising assembly of the present invention.

DETAILED DESCRIPTION OF THE INVENTION

Figure 1:
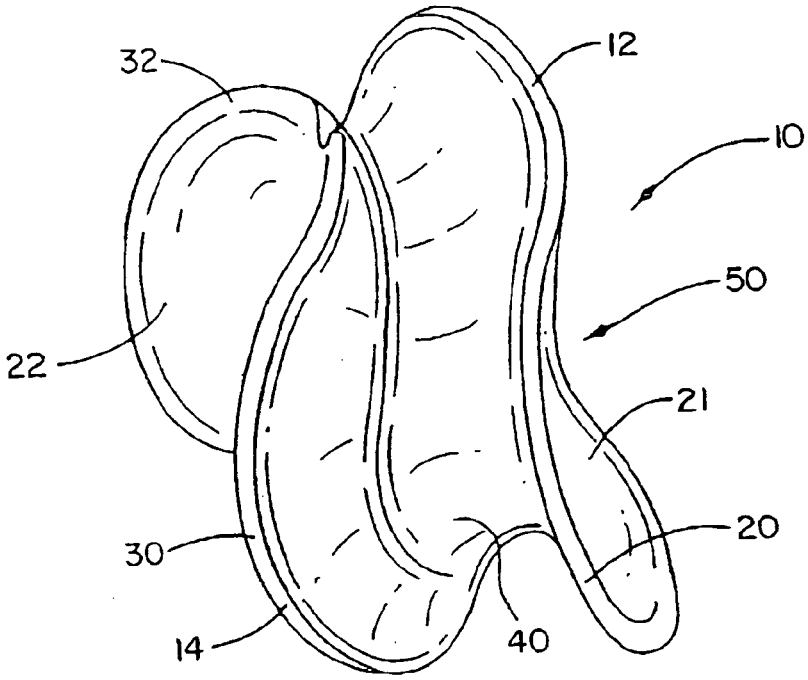
FIG. 1 is a side pictorial view of the annular exercising assembly of the present invention.

Before explaining at least one embodiment of the invention in detail, it is to be understood that the invention is not limited in its application to the details of construction and the arrangements of the components set forth in the following description or illustrated in the drawings. The invention is capable of other embodiments or of being practiced or carried out in various ways. Also, it is to be understood that the phraseology and terminology employed herein is for purpose of description and should not be regarded as limiting.

Figure 2:
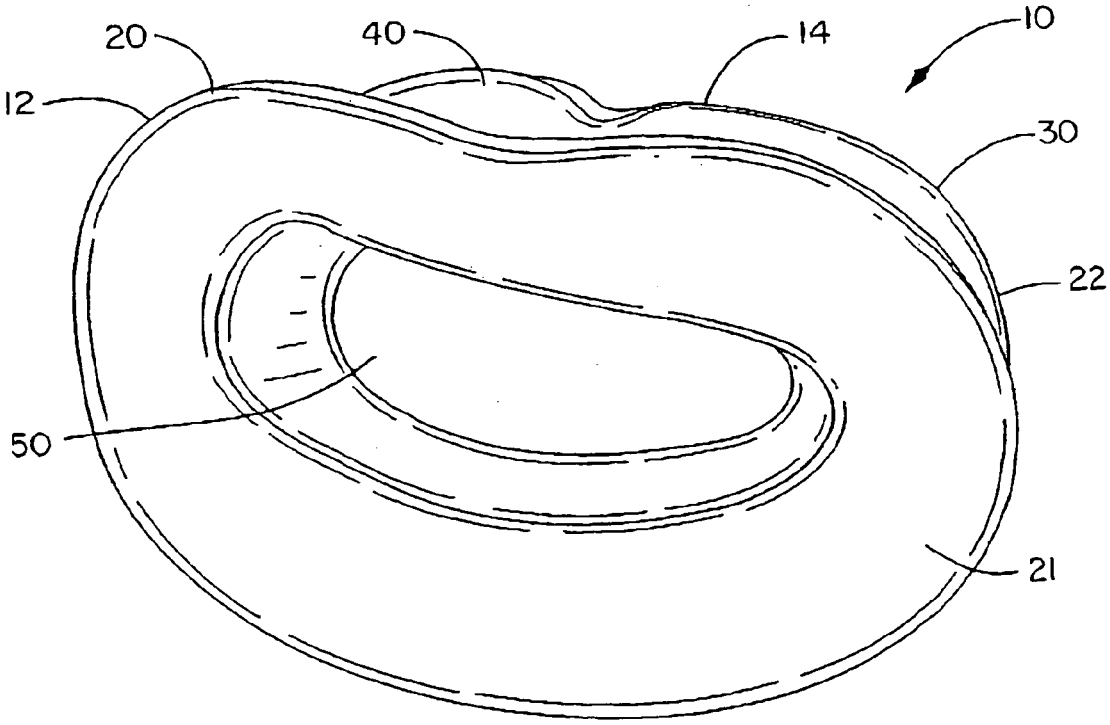
FIG. 2 is a front pictorial view of the annular exercising assembly of the present invention.

The present invention encompasses an annular exercising (either isometric or isotonic exercises) assembly for use within a user's mouth, and more particularly, between the user's lips in such a manner that the user's upper and lower teeth are not in a substantially engaged position. The annular exercising assembly is shown generally in the side pictorial view of FIG. 1, the front pictorial view of FIG. 2, and the front, top, and side plan views of FIGS. 4, 5, and 6 respectively, and referenced by numeral 10. Annular exercising assembly 10 is generally defined as having-an exterior member 12 and an interior member 14. The exterior member 12 is kept in a spaced apart relationship to the interior member 14. Exterior member 12 also has an exterior peripheral edge 20, and the interior member 14 has an interior peripheral edge 30.

The exterior peripheral edge 20 has an exterior side 21 and an interior side 22 and the interior peripheral edge 30 has an interior side 31 and an exterior side 32. A trough shaped area 40 is generally defined by the area between the exterior peripheral edge 20 and the interior peripheral edge 30 and the bottom of the trough shaped area 40 is generally defined as the intersection of the exterior peripheral edge 20 and the interior peripheral edge 30. The annular exercising assembly 10 has a passageway 50 extending there-through extending from the exterior side 21 of the exterior peripheral edge 20 to the exterior side 32 of the interior peripheral edge 30.

The annular exercising assembly 10 also has a passageway 50 extending from the exterior side 21 of the exterior peripheral edge 20 to the exterior side 32 of the interior peripheral edge 30. The passageway 50 can be more easily seen in the front pictorial view of FIG. 2 which shows a frontal view of the annular exercising assembly 10. The passageway 50 can be of any shape so long as it permits visual inspection of the inside of the mouth during use. Such visualization is important to ensure that the teeth are kept in a centric position, thereby maintaining (1) the TMJ joint in a relaxed state and (2) an unobstructed airway. Indeed the unobstructed airway allows a user to keep an appropriate and necessary means of air intake and $CO_2$ exhalation from the user during exercise thereby allowing for unimpeded respiration.

The annular exercising assembly 10 is generally sized and shaped to fit an individual user's mouth and lip structure. Thus, it will be appreciated that the annular exercising assembly 10 is preferably custom fitted and/or fabricated to each user's unique mouth/lip structure. Although such customization is desirous, one may make a general adaptation of the annular exercising assembly 10 which would fit the size and shape of a broad range of user's mouths and/or lip structures. For example, if the user's mouth is small and narrow, (and hence the lip structure would also be narrow) the annular exercising assembly 10 would be sized and shaped to fit the small and narrow opening created by the user when the user's (1) mouth and lips are barely open and (2) the upper and lower teeth are almost touching. Furthermore, since the annular exercising assembly 10 is "free standing"—i.e. held in place solely by the lip and gum tissue of the user—sizing and shaping the annular exercising assembly 10 to each unique and individual user is preferred. Such a "free standing" configuration is ideally suited to most isometric or isotonic exercises where the user's hands are often needed for balance and/or gripping.

The annular exercising assembly 10 is fabricated from any shape-sustaining or shape-retaining material which can be molded to fit a general form and/or custom fitted to a specific user. Examples of appropriate shape-sustaining or shape-retaining materials which can be used in the present invention include nontoxic plastics, plastic laminates, or acrylics such as dental acrylic. One of ordinary skill in the art will appreciate that the annular exercising assembly 10 of the present invention can be fabricated from a multitude of materials and such range of materials that are useful in the present invention is only limited by the need to have a material that is substantially rigid, substantially flexible, or semi-flexible and that is also shape-sustaining or shape-retaining.

Figure 3:
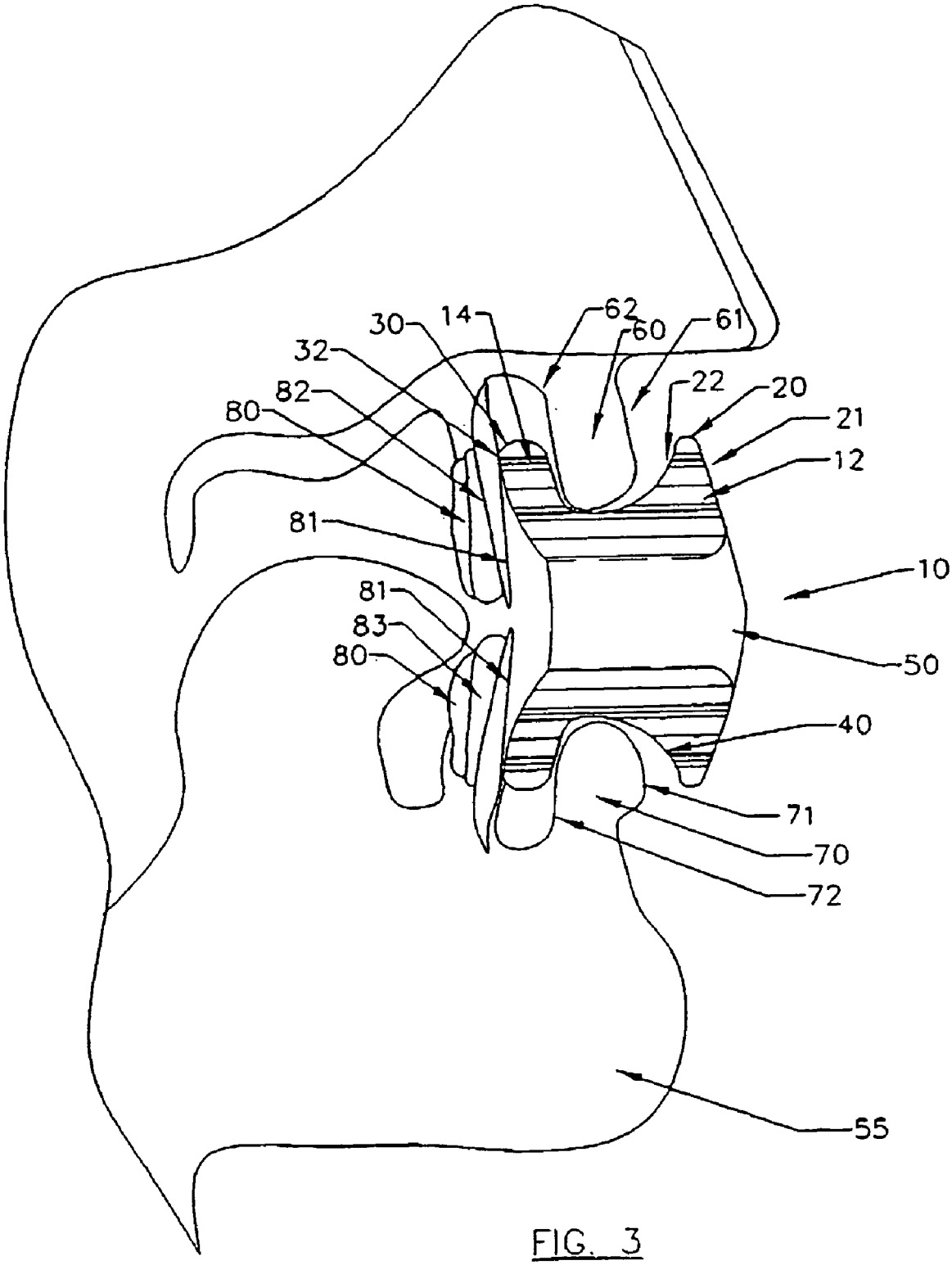
FIG. 3 is a side pictorial view of the annular exercising assembly of the present invention in use.

Placement of the user's lips in the annular exercising assembly 10 is shown in the cross-sectional side pictorial view of FIG. 3. A user 55 places the annular exercising assembly 10 between the user's 55 lips. An upper lip portion 60 of the user 55 and a lower lip portion 70 of the user 55 are placed into the trough shaped area 40. The upper lip portion 60 has an outside surface 61 and an inside surface 62, while the lower lip portion 70 has an outside surface 71 as well as an inside surface 72. Thus, and is shown in FIG. 3, when in place in the user's 55 mouth, the exterior member 12 of the annular exercising assembly 10 is outside the user's 55 mouth, while the interior member 14 of the annular exercising assembly 10 is inside the user's 55 mouth. In this manner, the annular exercising assembly 10 is held in place in the user's 55 mouth.

More particularly, when the annular exercising assembly 10 is placed between the user's 55 lips the interior side 22 of the exterior peripheral edge 20 is adjacent the outside surface 61 of the upper lip portion 60 as well as the outside surface 71 of the lower lip portion 70, and the interior side 31 of the interior peripheral edge 30 is adjacent the inside surface 62 of the upper lip portion 60 as well as the inside surface 72 of the lower lip portion 70. In the same manner, when the annular exercising assembly 10 is placed between the user's 55 lips and more particularly the exterior side 32 of the interior peripheral edge 30 is adjacent an outside surface 81 of the user's 55 teeth 80.

In using the annular exercising assembly 10, the user 55 places the annular exercising assembly 10 between their lips also more particularly as outlined herein above. Once the annular exercising assembly 10 is in place, the user 55 brings the upper lip portion 60 toward the lower lip portion 70. By bringing the upper lip portion 60 toward the lower lip portion 70 while using the annular exercising assembly 10, the user 55 is able to contract, strain, and/or tense the muscles surrounding the larynx thereby increasing the isometric or isotonic resistance and/or effect of the a particular exercise being undertaken. Alternatively or in combination with bringing the upper lip portion 60 toward the lower lip portion 70, the user 55 may contract and bring a right corner lip portion 65 toward a left corner lip portion 75. In this manner, all the muscle groups surrounding the lips face, neck and larynx can be exercised in a sequential fashion.

Figure 4:
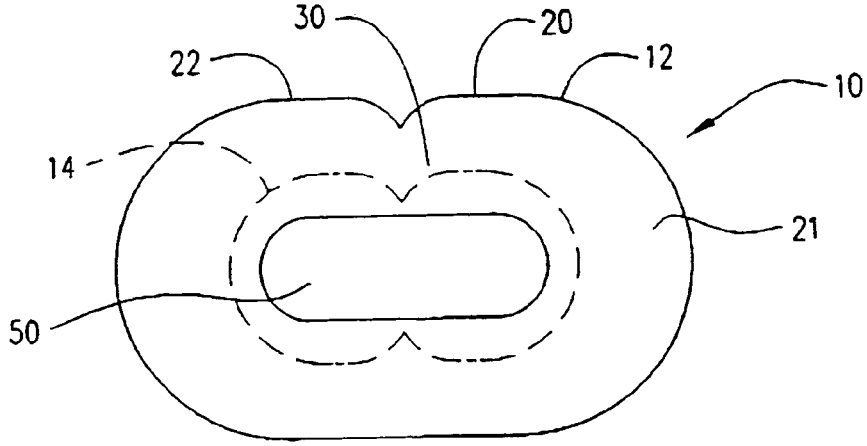
FIG. 4 is a front plan view of the annular exercising assembly of the present invention.
Figure 5:
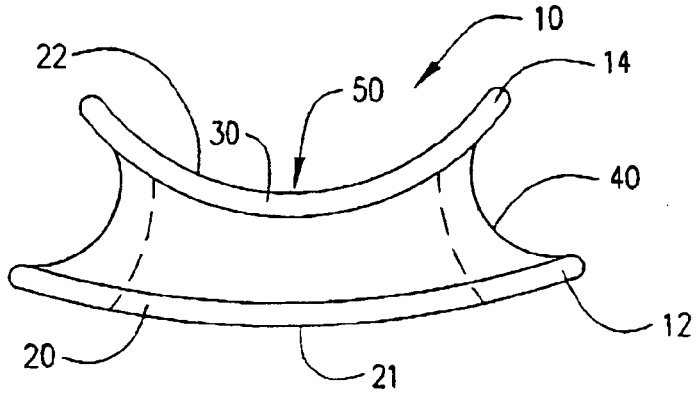
FIG. 5 is a top plan view of the annular exercising assembly of the present invention.
Figure 5:
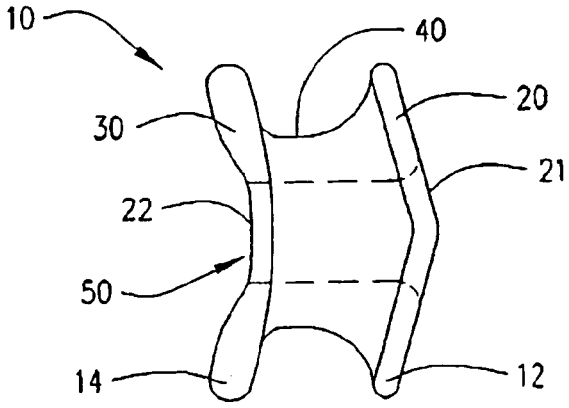

FIG. 4 is a frontal view of the annular exercising assembly 10 in a user's 55 mouth. As can be appreciated from FIG. 4, when the annular exercising assembly 10 is placed in the user's 55 mouth, and the upper lip portion 60 is brought toward the lower lip portion 70, the user's 55 teeth 80 are in a relaxed position—i.e. an upper set 82 of the teeth 80 do not engage a lower set 83 of the teeth 80. In this manner, the TMJ joint is neither stressed nor tensed during use of the annular exercising assembly 10.

During use, the annular exercising assembly 10 tenses the soft palate and the tongue base which includes the pharyngeal muscles. Indeed, the annular exercising assembly 10 globally exercises numerous muscle groups thereby, isometrically or isotonically toning the face, neck and body simultaneously. Through exercising these muscle groups, incidences of sleep apnea can be reduced and or eliminated for example, the annular exercising assembly 10 tones the muscles of the soft palate, tongue and tongue base, as well as the pharyngeal area. The toning of these muscles is instrumental in the reduction of sleep apnea incidents. Swallowing disorders can also be decreased through the toning of the muscle groups and vocal output is strengthened and clarified. Through use of the annular exercising assembly 10, muscles of the nasal region and especially the levator labii superioris alaeque nasi and the nares in general tighten. Through such tightening, the formation of polyps in the sinuses (which restrict airflow) can be substantially reduced. This effect may be attributed to a massaging quality to the movement of the maxillary and nasal muscles with increased blood flow to the sinuses. By changing the type and duration of exercises used with the annular exercising assembly 10, individual muscle groups can be targeted thereby, specifically toning the face and neck for example, thereby giving the user a more youthful appearance. In general, the annular exercising assembly 10 generally activates and/or tenses the following muscle groups: Nasal region, Maxillary region, Mandibular region, Intermaxillary region, Tempero-mandibular region, the Pterygo-mandibular region and the labial region. Further, the annular exercising assembly 10 employs leverage and tensing of the Thyroid cartilage and results in intensified muscle toning in a minimum amount of time.

Since the annular exercising assembly 10 is held in place only by the user's lips, no stress or strain is placed on the TMJ joint by compression of the teeth or an excursion of the jaws. The use of the annular exercising assembly 10 during exercise will not effect the delicate balance of the TMJ joint and further serves to strengthen the tissues and muscles surrounding the TMJ joint, thus resulting in a better support system for the TMJ joint.

The annular exercising assembly 10 also aids in globally exercising the lip and mid-face muscles in two movements, thus allowing the muscles to work together and results in a faster toning process, one example of such toning resulting in preservation of the bow effect of the upper lip. In toning the lips, a user 55 is able to prevent and/or minimize the appearance of wrinkles and eliminates painful cracking of the lips from deep wrinkles. As we age, musculature around the mouth and neck weakens. Using the annular exercising assembly 10, a user can arrest such muscle deterioration. Once the annular exercising assembly 10 has been placed between the user's 55 lips, a regimen of isometric or isotonic exercises are preformed in both a vertical plane, by compressing the upper lip portion 60 toward the lower lip portion 70, and in a horizontal plane by compressing the right corner lip portion 65 toward the left corner lip portion 75. Thus, the present invention is an isometric or isotonic exercising tool that is freestanding in construction and is held in place by the user's 55 lips without the need for an external support mechanism or intra oral support system past the lingual wall and anterior gum. The annular exercising assembly 10 is held by the user's 55 lips in the anterior, medial or posterior position and is capable of exercising all the muscles in at least two movements. In this manner, many muscle groups are exercised in isolation as well as in relation to one another. Strengthening of these muscle groups effectively improves posture and endurance necessary for tedious and repetitious tasks which involve body postures that stress the neck and facial muscles. One effect is the diminished appearance of a double chin and a more defined jaw line which increases the user's 55 youthful appearance.

The structure of the annular exercising assembly 10 holds the user's 55 lips in a neutral position while the user 55 performs an isometric or isotonic exercise. By keeping the lips in a neutral position, a contraction and/or pursing of any part of the lips, which may reinforce the presence of wrinkles, is prevented. Furthermore, since the annular exercising assembly 10 supports the anterior surface of the lips, use of the annular exercising assembly 10 preserves the youthful appearance of the bow effect in the upper mid-lip area.

The use of the annular exercising assembly 10 results in toned mid-face muscles thereby giving a younger appearance to the mid-face and jaw area. Through the toning of the mid-face muscles which are used in the mastication of food, older users will find that they acquire a stronger bite and have greater ease in chewing boluses.

Through use of the annular exercising assembly 10, the whole body of the user 55 may be isometrically or isotonically exercised. The annular exercising assembly 10 may be used only to tone the facial neck areas or it may be used in conjunction with isometric or isotonic exercises using only body parts or other exercising equipment that allows the holding of muscle groups in a tensed position. In this manner the whole body can be exercised in less than five minutes thereby saving time and increasing muscle tone. Increased muscle tone helps support tissue surrounding the joints and does not allow the joints to slip thereby decreasing injuries to the joints. The toning of the muscle groups will also delay the atrophy of these muscles. Combining the annular exercising assembly 10 with isometric or isotonic exercises using chest and/or back muscle groups gives a more defined appearance of the pectoralis muscles and adds strength to the upper torso. Women user's thereby firm and increase breast tissue leading to an increased bust size. Thus, through use of the annular exercising assembly 10 and simple upper body exercises, costly and dangerous breast implants can be avoided, as well as the inherent risks in any such surgery.

Use of the annular exercising assembly 10 may be enhanced by using the device in a laying down position and pressing the palms of the hands together across the chest.

During times of constipation, use of the annular exercising assembly 10 during bowel movements results in the pushing of fecal matter through the colon/anus by contractions of the muscles in a top downward movement rather than the straining in the perineum area. In this manner, the use of laxatives and/or enemas can be eliminated and the decrease in straining will result in the prevention of enlarging hemorrhoids. Use of the annular exercising assembly 10 with muscle contractions focused on the perineum area results in further strengthening of the bowel and bladder walls. Results from this combination of exercises and the annular exercising assembly 10 control incontinence better than the use of Kegel exercised done with muscle contraction of the peritoneal area alone. Eliminating and/or controlling incontinence in this manner decreases the economic (cost of pads, etc.) and social (isolation, etc.) impacts of a user who is incontinent. Finally, use of the annular exercising assembly 10 with a regular exercise regimen leads to a massaging effect of the vascular system thereby resulting in a lowering of a user's blood pressure and concomitant circulatory disorders.

Figure 7:
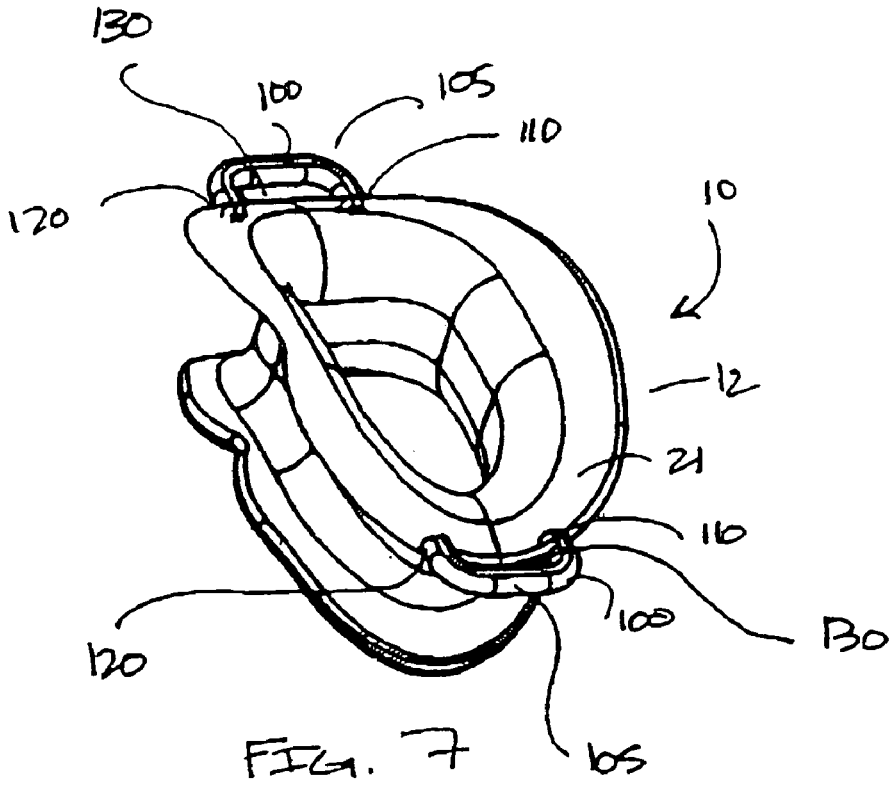
FIG. 7 is a top perspective view of an alternate embodiment of the annular exercising assembly of the present invention.
Figure 8:
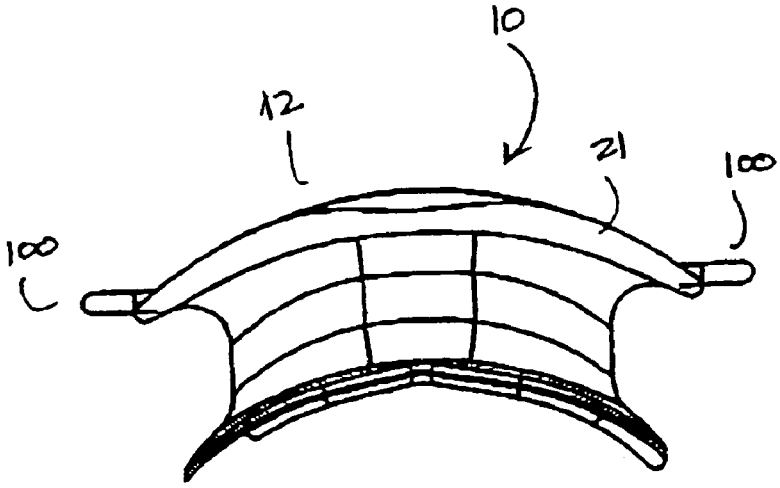
FIG. 8 is a top plan view of the alternate embodiment of the annular exercising assembly shown in FIG. 7.

An alternate embodiment of the annular exercising assembly 10 is shown in FIGS. 7 and 8. In this alternate embodiment, the annular exercising assembly 10 further includes at least one connection member 100 having an elongated tubular assembly 105, having a first end 110, and a second end 120.

The first and second ends 110, 120, respectively, are connected to the exterior side 21 of the exterior member 12, so as to define a passageway 130. The passageway 130 and the elongated tubular assembly 105 form the at least one connection member 100. The at least one connection member 100 serves the purpose of having an exterior point on the annular exercising assembly 10 to allow a user, physical therapist, doctor and/or aide (to name but a few) to position, hold, or remove the annular exercising assembly 10 in the user's mouth. Additionally, the at least one connection member 100 provides a loop or hoop like device to which a cord (not shown) may be attached. Such a cord (not shown) could allow the user to keep the annular exercising assembly 10 hung about the user's neck and/or attached to the user's person in much the same manner as a pacifier may be attached to a baby's clothes and/or similar to eye-glass chains which allow glasses to be suspended from a user's neck when not in use.

Another alternative embodiment of the annular exercising assembly 10 is shown in FIGS. 9–12. In this alternative embodiment, the annular exercising assembly 10 further includes an airway protection assembly 140 having a grid-like appearance. The airway protection assembly 140 may be positioned within or about the passageway 50 of the annular exercising assembly 10. The airway protection assembly 140 may be constructed from a metal screen, gauze, string or any other such material allowing for the passage of air while preventing the entry of foreign objects (such as dust, dirt, debris, insects, such as flies, etc.) into a user's airway. While the airway protection assembly 140 is shown having a grid-like appearance, it should be understood that any such configuration may be provided so long as the airway protection assembly 140 acts in the way it is intended and described herein, that is, to allow the passage of air through the passageway 50 of the annular exercising assembly 10.

Figure 9:
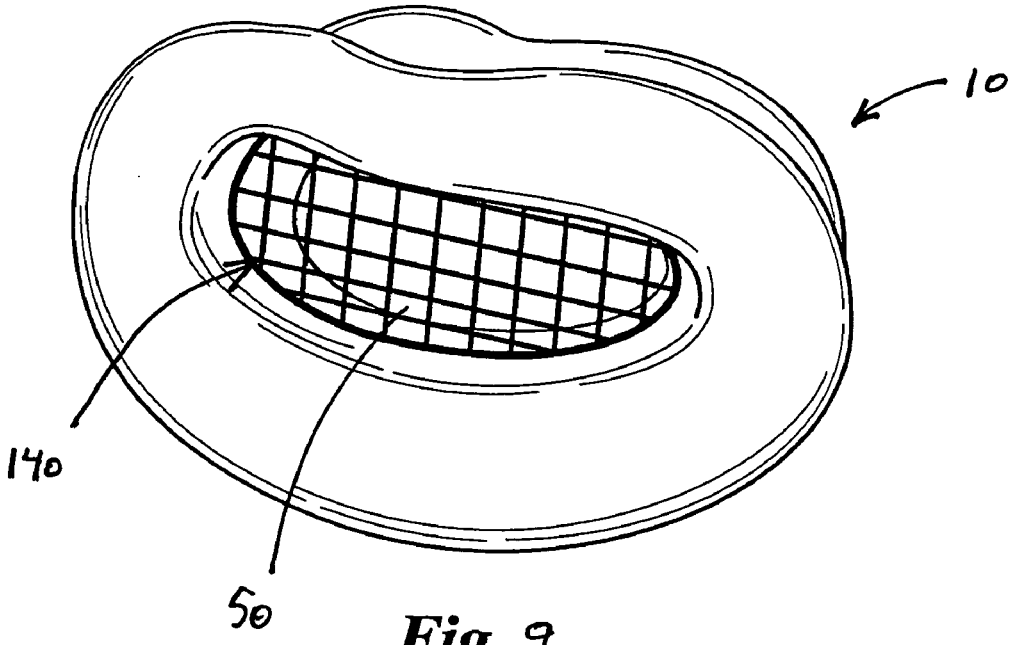
FIG. 9 is a frontal pictorial view of the annular exercising assembly shown in FIG. 2 provided with an airway protection assembly.
Figure 10:
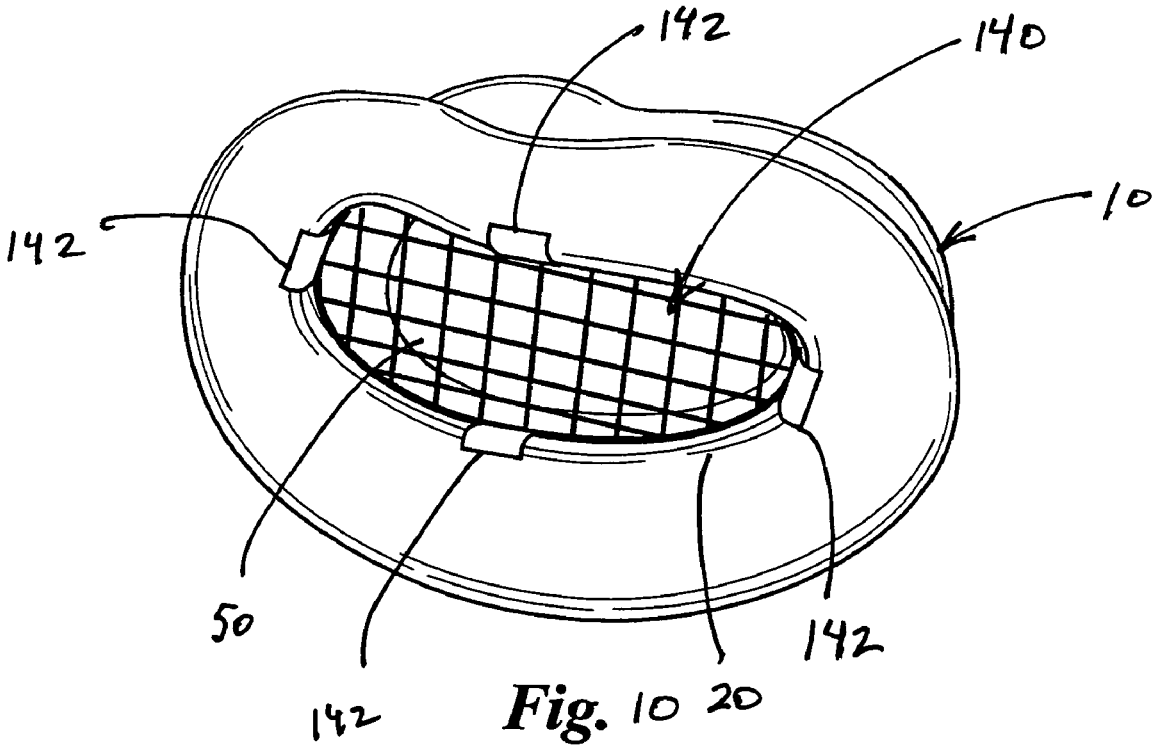
FIG. 10 is another embodiment of the annular exercising assembly shown in FIG. 9.

The airway protection assembly 140 may be fixed or removable. As shown in FIG. 9, the airway protection assembly 140 may be generally sized and shaped to fit within or about the passageway 50 of the annular exercising assembly 10. It should be understood that the airway protection assembly 140 may be affixed within the passageway 50 of the annular exercising assembly 10 with an adhesive or other such bonding material. Further, as shown in FIG. 10, the airway protection assembly 140 may be provided with a plurality of stabilizing members 142 positioned about an external peripheral edge 144 of the airway protection assembly 140. The stabilizing members 142 are sized and shaped to engage the exterior peripheral edge 20 of the annular exercising assembly 10 allowing for the airway protection assembly 140 to be positioned within the passageway 50 of the annular exercising assembly 10. Alternatively, a plurality of grooves (not shown) may be formed in the exterior side 21 of the exterior peripheral edge 20 or the exterior side 32 of the interior peripheral edge 30 of the annular exercising assembly 10 for receiving the stabilizing members 142 and fastening the airway protection assembly 140 to the annular exercising assembly 10.

Figure 11:
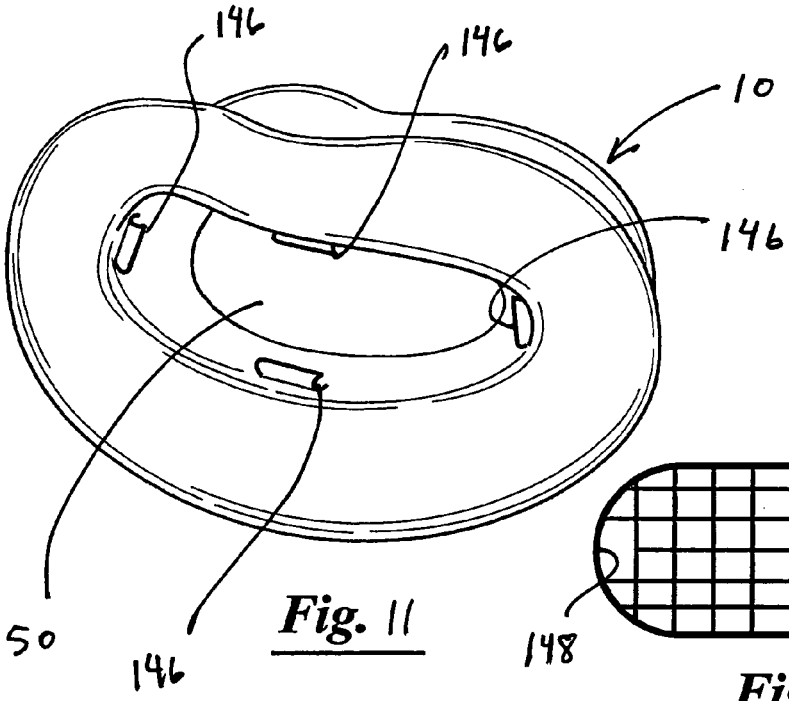
FIG. 11 is an alternative embodiment of the annular exercising assembly shown in FIG. 2.
Figure 11A:
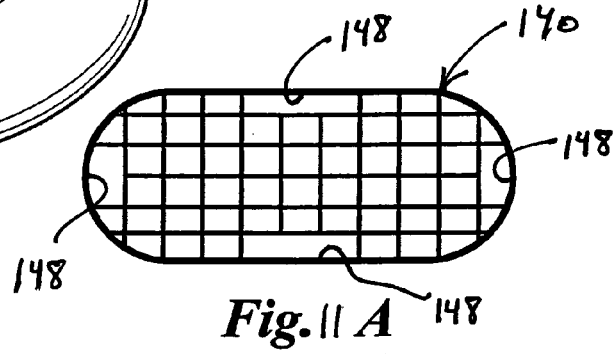
FIG. 11*a* is a frontal view of an airway protection assembly.

As shown in FIGS. 11 and 11*a*, the annular exercising assembly 10 may be provided with a plurality of hooks 146 positioned about the interior peripheral edge 30 of the annular exercising assembly 10. The airway protection assembly 140 may be provided with a plurality of spaces 148 corresponding to the hooks 146 allowing the the airway protection assembly 140 to be connected to the annular exercising assembly 10 and positioned about the passageway 50 of the annular exercising assembly 10.

Figure 12:
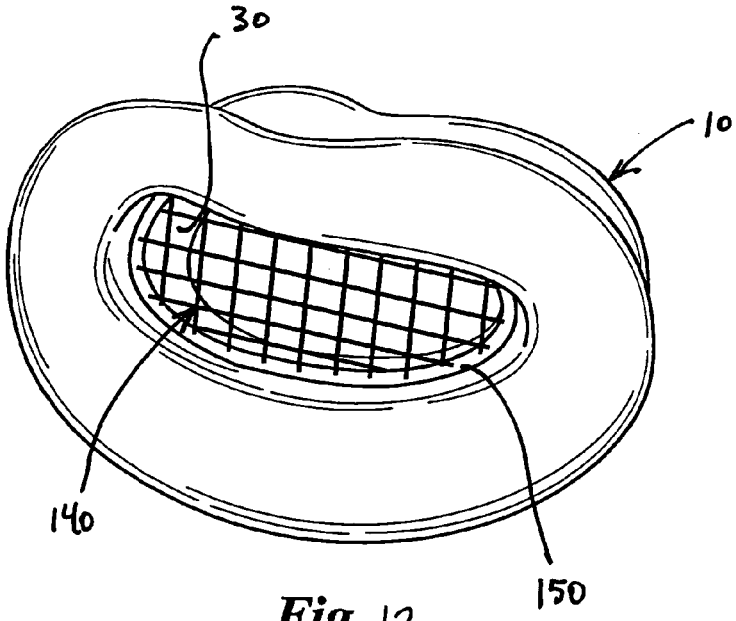
FIG. 12 is an alternative embodiment of the annular exercising assembly shown in FIG. 9.

Referring to FIG. 12, another embodiment of the annular exercising assembly 10 is shown. The airway protection assembly 140 may be provided with an exterior wall 150 that extends from the external peripheral edge 144 of the airway protection assembly 140 to conform to the interior peripheral edge 30 of the annular exercising assembly 10. The exterior wall 150 is positioned to engage the interior peripheral edge 30 of the annular exercising assembly 10, thus preventing the airway protection assembly 140 from slipping into the user's airway.

Thus, it should be apparent that there has been provided in accordance with the present invention an annular exercising assembly 10 and methods for using same that fully satisfy the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What I claim is:

1. A method for enhancing isometric or isotonic resistance during exercise, comprising the steps of:

providing an annular exercising assembly sized and shaped so as to fit in a user's mouth around an entire circumference of a user's lips and a user's corner lip portions and in front of an outside surface of the user's teeth, the annular exercising assembly having an exterior member, an interior member having an exterior side, and a trough formed by the connection of the exterior member to the interior member, the trough extending around the entire circumference of a user's mouth and being sized and shaped to accept a user's upper lip area, a user's lower lip area, a user's right corner lip portion, and a user's left corner lip portion therein, and wherein when the user's lips and the user's corner lip portions are inserted in the trough, the user's upper and lower teeth are kept in a substantially non-engaged position, and the exterior side of the interior member is adjacent the outside surface of the user's teeth, and the annular exercising assembly further having a passageway extending from the exterior member to the interior member with the passageway allowing for unimpeded breathing of the user;

positioning an airway protection assembly in relation to the passageway of the annular exercising assembly for allowing the passage of air and preventing the entry of foreign objects into the user's airway;

placing the annular exercising assembly in the user's mouth around the entire circumference of a user's lips and a user's corner lip portions;

compressing the annular exercising assembly between the upper lip area and the lower lip area; and performing a predetermined exercise while the annular exercising assembly is compressed between the upper lip area and the lower lip area.

2. The method of claim 1, wherein in the step of providing an annular exercising assembly, the interior member has an interior peripheral edge substantially adjacent an inside surface of the user's upper and lower lip portions and wherein the exterior member has an exterior peripheral edge substantially adjacent an outside surface of a user's upper and lower lip.

3. The method of claim 2, wherein in the step of providing an annular exercising assembly, the annular exercising assembly is fabricated from a plastic or plastic laminate or combinations thereof.

4. The method of claim 1 wherein the airway protection assembly comprises a screen or a meshed wire.

5. A method for enhancing isometric or isotonic resistance during exercise, comprising the steps of:

providing an annular exercising assembly sized and shaped so as to fit in a user's mouth around an entire circumference of a user's lips and a users corner lip portions and in front of an outside surface of the user's teeth, the annular exercising assembly having an exterior member, an interior member having an exterior side, and a trough formed by the connection of the exterior member to the interior member, the trough extending around the entire circumference of a user's mouth and being sized and shaped to accept a user's upper lip area, a user's lower lip area, a user's right corner lip portion, and a user's left corner lip portion therein, and wherein when the user's lips and the user's corner lip portions are inserted in the trough, the user's upper and lower teeth are kept in a substantially non-engaged position, and the exterior side of the interior member is adjacent the outside surface of the user's teeth, the annular exercising assembly further having a passageway extending from the exterior member to the interior member with the passageway allowing for unimpeded breathing of the user; and the annular exercising assembly further having an airway protection assembly in relation to the passageway of the annular exercising assembly for allowing the passage of air and preventing the entry of foreign objects into the user's airway;

placing the annular exercising assembly in the user's mouth around the entire circumference of the user's lips and the user's corner lip portions;

compressing the annular exercising assembly between the upper lip area and the lower lip area; and performing a predetermined exercise while the annular exercising assembly is compressed between the upper lip area and the lower lip area.

6. The method of claim 5, wherein in the step of providing an annular exercising assembly, the interior member has an interior peripheral edge substantially adjacent an inside surface of the user's upper and lower lip portions and wherein the exterior member has an exterior peripheral edge substantially adjacent an outside surface of a user's upper and lower lip.

7. The method of claim 6, wherein in the step of providing an annular exercising assembly, the annular exercising assembly is fabricated from a plastic or plastic laminate or combinations thereof.

8. The method of claim 5 wherein the airway protection assembly comprises a screen or a meshed wire.

* * * * *